US008727478B2

(12) United States Patent
Jones et al.

(10) Patent No.: US 8,727,478 B2
(45) Date of Patent: May 20, 2014

(54) INK LOADER HAVING OPTICAL SENSORS TO IDENTIFY SOLID INK STICKS

(71) Applicant: Xerox Corporation, Norwalk, CT (US)

(72) Inventors: Brent R. Jones, Sherwood, OR (US); Frederick T. Mattern, Portland, OR (US); Brian W. Aznoe, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 50 days.

(21) Appl. No.: 13/653,787

(22) Filed: Oct. 17, 2012

(65) Prior Publication Data

US 2014/0104340 A1 Apr. 17, 2014

(51) Int. Cl.
*B41J 29/393* (2006.01)
*B41J 2/175* (2006.01)

(52) U.S. Cl.
USPC ..... 347/19

(58) Field of Classification Search
USPC ..... 347/5, 19, 88, 99
See application file for complete search history.

(56) References Cited

U.S. PATENT DOCUMENTS

| | | | |
|---|---|---|---|
| 3,722,240 | A | 3/1973 | Spain et al. |
| 4,636,803 | A | 1/1987 | Mikalsen |
| 4,723,135 | A | 2/1988 | Yano et al. |
| 4,889,560 | A | 12/1989 | Jaeger et al. |
| 5,023,388 | A | 6/1991 | Luker |
| 5,135,165 | A | 8/1992 | Greenhow |
| 5,181,049 | A | 1/1993 | Mackay et al. |
| 5,223,860 | A | 6/1993 | Loofbourow et al. |
| 5,442,387 | A | 8/1995 | Loofbourow et al. |
| 5,734,402 | A | 3/1998 | Rousseau et al. |
| 5,861,903 | A | 1/1999 | Crawford et al. |
| 5,908,950 | A | 6/1999 | Cooke et al. |
| 5,975,688 | A | 11/1999 | Kanaya et al. |
| 5,975,690 | A | 11/1999 | Grellmann et al. |
| 5,988,805 | A | 11/1999 | Meinhardt |
| 6,053,608 | A | 4/2000 | Ishii et al. |
| 6,213,600 | B1 | 4/2001 | Kobayashi et al. |
| 6,353,479 | B1 | 3/2002 | Lubawy et al. |
| 6,422,694 | B1 | 7/2002 | Hollands |
| 6,543,867 | B1 | 4/2003 | Jones |
| 6,572,225 | B1 | 6/2003 | Jones |
| 6,672,716 | B2 | 1/2004 | Jones |
| 6,719,419 | B2 | 4/2004 | Jones et al. |
| 6,722,764 | B2 | 4/2004 | Jones et al. |
| 6,739,713 | B2 | 5/2004 | Jones et al. |
| 6,755,517 | B2 | 6/2004 | Jones et al. |
| 6,761,443 | B2 | 7/2004 | Jones |
| 6,840,612 | B2 | 1/2005 | Jones et al. |
| 6,986,570 | B2 | 1/2006 | Jones et al. |
| 7,063,412 | B2 | 6/2006 | Jones et al. |
| 7,108,363 | B2 | 9/2006 | Jones et al. |
| 7,163,273 | B2 | 1/2007 | Silverbrook |
| 7,438,402 | B2 | 10/2008 | Jones et al. |

(Continued)

*Primary Examiner* — Anh T. N. Vo
(74) *Attorney, Agent, or Firm* — Maginot, Moore & Beck, LLP

(57) ABSTRACT

An ink loader enables identification of features on a solid ink stick placed on an ink stick support in the ink loader. The ink loader includes two optical sources configured to emit diffuse light toward different surfaces of the solid ink stick. Two corresponding sets of optical sensors are positioned to receive light reflected from identifying features, if present, on the solid ink stick. A controller receives signals generated by the two sets of optical sensors and identifies the ink stick with reference to the signals from the sensors.

20 Claims, 3 Drawing Sheets

(56) References Cited

U.S. PATENT DOCUMENTS

| | | | |
|---|---|---|---|
| 7,517,072 | B2 | 4/2009 | Jones et al. |
| 7,537,326 | B2 | 5/2009 | Jones |
| 7,553,008 | B2 | 6/2009 | Jones |
| 7,648,232 | B2 | 1/2010 | Jones |
| 7,690,775 | B2 | 4/2010 | Jones et al. |
| 7,695,126 | B2 | 4/2010 | Jones et al. |
| 7,726,798 | B2 | 6/2010 | Mattern et al. |
| 7,753,509 | B2 | 7/2010 | Chambers et al. |
| 7,753,511 | B2 | 7/2010 | Jones et al. |
| 7,762,655 | B2 | 7/2010 | Fairchild et al. |
| 7,780,283 | B2 | 8/2010 | Jones |
| 7,780,284 | B2 | 8/2010 | Fairchild et al. |
| 7,794,072 | B2 | 9/2010 | Esplin et al. |
| 7,798,624 | B2 | 9/2010 | Fairchild et al. |
| 7,798,626 | B2 | 9/2010 | Jones et al. |
| 7,798,627 | B2 | 9/2010 | Esplin et al. |
| 7,802,880 | B2 | 9/2010 | Jones et al. |
| 7,810,918 | B2 | 10/2010 | Jones et al. |
| 7,819,513 | B2 | 10/2010 | Fairchild |
| 7,837,317 | B2 | 11/2010 | Gold et al. |
| 7,854,501 | B2 | 12/2010 | Jones |
| 7,857,439 | B2 | 12/2010 | Jones et al. |
| 7,857,440 | B2 | 12/2010 | Gold et al. |
| 7,874,661 | B2 | 1/2011 | Tidrick |
| 7,878,641 | B2 | 2/2011 | Fairchild et al. |
| 7,883,195 | B2 | 2/2011 | Fairchild et al. |
| 7,883,196 | B2 | 2/2011 | Mattern et al. |
| 7,891,792 | B2 | 2/2011 | Gold et al. |
| 7,942,515 | B2 | 5/2011 | Mattern et al. |
| 7,971,980 | B2 | 7/2011 | Jones et al. |
| 7,976,144 | B2 | 7/2011 | Esplin et al. |
| 8,007,095 | B2 | 8/2011 | Tidrick |
| 8,016,403 | B2 | 9/2011 | Jones et al. |
| 8,025,385 | B2 | 9/2011 | Jones et al. |
| 8,075,118 | B2 | 12/2011 | Chambers et al. |
| 8,075,119 | B2 | 12/2011 | Fairchild |
| 8,079,690 | B2 * | 12/2011 | Johnson et al. ..... 347/88 |
| 8,096,647 | B2 | 1/2012 | Jones |
| 8,167,418 | B2 | 5/2012 | Jones |
| 8,240,831 | B2 | 8/2012 | Dixon |
| 2003/0038851 | A1 | 2/2003 | Oriol |
| 2003/0202056 | A1 | 10/2003 | Jones et al. |
| 2003/0202074 | A1 | 10/2003 | Jones |
| 2003/0202077 | A1 | 10/2003 | Jones et al. |
| 2003/0202078 | A1 | 10/2003 | Jones et al. |
| 2006/0279617 | A1 | 12/2006 | Korn et al. |
| 2008/0088688 | A1 | 4/2008 | Jones et al. |
| 2008/0117265 | A1 | 5/2008 | Esplin et al. |
| 2012/0013689 | A1 | 1/2012 | Gold et al. |
| 2012/0092425 | A1 | 4/2012 | Mattern et al. |

* cited by examiner

INK LOADER HAVING OPTICAL SENSORS TO IDENTIFY SOLID INK STICKS

TECHNICAL FIELD

This disclosure relates generally to phase change inkjet printers, and, in particular, to ink stick loaders in such printers.

BACKGROUND

Solid ink or phase change ink printers encompass various imaging devices, including copiers and multi-function devices. These printers offer many advantages over other types of image generating devices, such as laser and aqueous inkjet imaging devices. Solid ink or phase change ink printers conventionally receive ink in a solid form as pellets or as ink sticks. A color printer typically uses four colors of ink (yellow, cyan, magenta, and black).

The solid ink pellets or ink sticks, hereafter referred to as solid ink, sticks, or ink sticks, are delivered to a melting device, which is typically coupled to an ink loader, for conversion of the solid ink to a liquid. A typical ink loader includes multiple feed channels, one for each color of ink used in the printer. Each feed channel directs the solid ink within the channel toward a melting device located at the end of the channel. Solid ink at a terminal end of a feed channel contacts the melting device and melts to form liquid ink that can be delivered to a printhead. Inkjet ejectors in the printhead are operated using firing signals to eject ink onto a surface of an image receiving member.

In some printers, each feed channel has a separate insertion opening in which ink sticks of a particular color are placed and then are transported by a mechanical conveyor, gravity, or both along the feed channel to the melting device. In other solid ink printers, solid ink sticks of all colors are loaded into a single insertion port, where a mechanical sensor identifies the ink stick by physically contacting identification indicia on the ink sticks. An ink transport system then transports the ink stick to the proper feed channel for the inserted ink stick. However, printers having individual openings for each color of ink stick are susceptible to user error. In addition, mechanical sensors can limit the orientations in which an ink stick can be identified in the loader, and limit the amount of data that can be read from each ink stick. Thus, improved ink stick identification is desirable.

SUMMARY

A new ink loader system enables improved identification of ink sticks inserted in the ink loader. The system includes an insertion port having a support, the insertion port being configured to receive a solid ink stick and enable the solid ink stick to rest on the support, a first optical source in the insertion port, the first optical source being oriented to emit diffuse light toward a first face of the solid ink stick resting on the support, at least two optical sensors in the insertion port that are oriented to receive light reflected from the first face of the solid ink stick, the at least two optical sensors being oriented for different angles of reflection with respect to the first face of the solid ink stick to enable each optical sensor in the at least two optical sensors to receive reflected light from different portions of the first face of the solid ink stick and generate a signal corresponding to an amount of received reflected light, a second optical source in the insertion port, the second optical source being oriented to emit diffuse light toward a second face of the solid ink stick resting on the support, the second face being different than the first face of the solid ink stick, at least two more optical sensors in the insertion port that are oriented to receive light reflected from the second face of the solid ink stick, the at least two more optical sensors being oriented for different angles of reflection with respect to the second face of the solid ink stick to enable each optical sensor in the at least two more optical sensors to receive reflected light from different portions of the second face of the solid ink stick and generate a signal corresponding to an amount of received reflected light, and a controller operatively connected to the at least two optical sensors and the at least two more optical sensors, the controller being configured to identify a first feature of the solid ink stick from the signals generated by the at least two optical sensors and to identify a second feature of the solid ink stick from the signals generated by the at least two more optical sensors.

Another embodiment of a new ink loader also enables improved identification of ink sticks inserted into the loader. The system includes an insertion port having a support, the insertion port being configured to receive a solid ink stick and enable the solid ink stick to rest on the support, at least two optical sources in the insertion port, the at least two optical sources being oriented to emit light toward a first face of the solid ink stick resting on the support, each of the at least two optical sources being oriented for different angles of reflection with respect to the first face of the solid ink stick, a first optical sensor in the insertion port, the first optical sensor being oriented to receive light emitted by the at least two optical sources that is reflected from the first face of the solid ink stick, the first optical sensor being configured to generate a signal corresponding to an amount of reflected light received from the first face of the solid ink stick from each of the at least two optical sources, at least two more optical sources in the insertion port, the at least two more optical sources being oriented to emit light toward a second face of the solid ink stick resting on the support, each of the at least two more optical sources being oriented for different angles of reflection with respect to the second face of the solid ink stick, a second optical sensor in the insertion port, the second optical sensor being oriented to receive light emitted by the at least two more optical sources reflected from the second face of the solid ink stick, the second optical sensor being configured to generate signals corresponding to an amount of reflected light received from the second face of the solid ink stick from each of the at least two more optical sources, and a controller operatively connected to the first optical sensor, the second optical sensor, the at least two optical sources, and the at least two more optical sources, the controller being configured to activate each of the at least two optical sources and each of the at least two more optical sources in a predetermined sequence, and identify a first feature of the solid ink stick from the signals generated by the first optical sensor and to identify a second feature of the solid ink stick from the signals generated by the second optical sensor.

DETAILED DESCRIPTION

Figure 1:
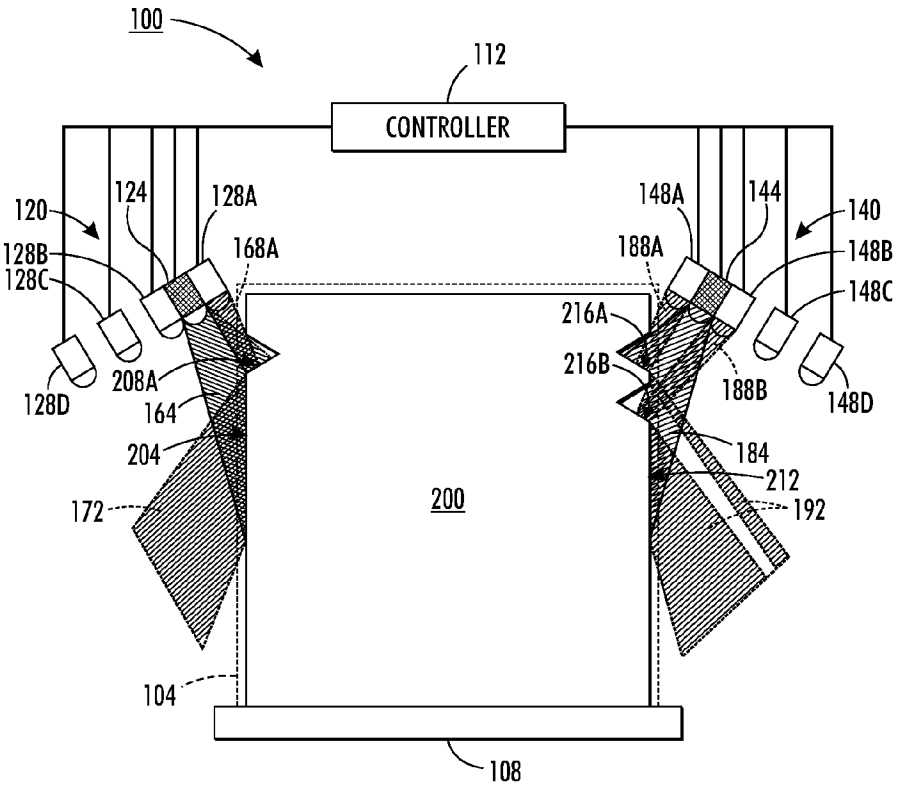
FIG. 1 is a side view of one embodiment of an ink loader having multiple detectors and a single light emitter to enable detection of an identifying feature in a surface of an ink stick.

For a general understanding of the present embodiments, reference is made to the drawings. In the drawings, like reference numerals have been used throughout to designate like elements. As used herein, the terms "printer," "printing device," or "imaging device" generally refer to a device that produces an image with one or more colorants on print media and may encompass any such apparatus, such as a digital copier, bookmaking machine, facsimile machine, multi-function machine, or the like, which generates printed images for any purpose. Image data generally include information in electronic form which are rendered and used to operate the inkjet ejectors to form an ink image on the print media. These data may include text, graphics, pictures, and the like. The operation of producing images with colorants on print media, for example, graphics, text, photographs, and the like, is generally referred to herein as printing or marking. Phase-change ink printers use phase-change ink, also referred to as a solid ink, which is in a solid state at room temperature but melts into a liquid state at a higher operating temperature. The liquid ink drops are printed onto an image receiving surface in either a direct printer, which ejects directly onto media, or an indirect printer, also known as an offset transfer printer.

FIG. 1 illustrates a solid ink loader 100. The solid ink loader 100 includes an insertion port 104, an ink stick support 108, a controller 112, a first optical reader 120, and a second optical reader 140. The insertion port 104 is configured to receive a solid ink stick 200 and enable the stick to rest on the ink stick support 108. In other embodiments, the ink stick support can be configured to move partially or completely outside the printer through the insertion port to receive a solid ink stick, and then to move back inside the printer to enable the solid ink stick to be identified. The support 108 can be in the form of a platform, or a conveyer. The conveyor can include one or more conveying members, for example, flat or round cross section belts.

The first optical reader 120 includes an optical source 124 and four optical sensors 128A-D. In the illustrated embodiment, the optical sensors 128A-D are positioned such that one of the sensors 128A is on one side of the optical source 124, while the other sensors 128B-D are on the other side of the optical source 124. In the embodiment of FIG. 1, the optical source 124 and sensors 128A-D are arranged substantially in a line, though in other embodiments the optical source and sensors can be arranged in any suitable configuration that enables each sensor to receive reflected light from a particular portion of the ink stick that is exclusive to the sensor. This configuration provides a sensor that is able to detect the presence or absence of an identifying feature in the surface of the ink stick at the portion of the ink stick effectively monitored by each sensor. Each of the optical sensors 128A-D generates an electrical signal that corresponds to an amount of light received by the sensor. Each sensor is also operatively connected to the controller 112 to enable the optical sensors 128A-D to deliver the electronic signals generated by each sensor to the controller 112.

The optical source 124 is a source of diffuse light that covers a segment of a face 204 of the ink stick 200 at an edge of the stick as the stick rests on the support 108. Identifying features on the ink stick, for example surface 208A, reflect a portion of the emitted light back toward one or more of the optical sensors 128A-D, for example optical sensor 128A in FIG. 1. Each of the sensors 128A-D is positioned to receive light from the source 124 that is reflected by a surface of an identifying feature. Thus, each sensor is positioned at a location where an angle of reflection is equal to an angle of incidence of light reaching an angled surface of an identifying feature from the source 124. When no identifying feature is present in the portion of the ink stick surface monitored by a sensor, the diffuse light from the source is not reflected into the sensor. Thus, the magnitude of the electronic signal generated by a sensor indicates to the controller 112 whether the identifying feature is present or not. Light scatters, especially from surfaces that are imperfectly shaped or that have a texture, intentional or not. Sensors used for detection see scattered light, but the signal amplitude varies with reference to the intensity of the reflected light. Consequently, direct reflections can be electronically differentiated from indirect reflections. Signal processing methods to implement this differentiation are well known and can include threshold limits or comparative signal levels. For example, a signal voltage being greater than a reference voltage indicates the reflective feature is present.

The second optical reader 140 also includes a second optical source 144 and four optical sensors 148A-D, arranged substantially in a straight line. The second optical source 144 emits diffuse light and is positioned between optical sensor 148A and optical sensor 148B, such that three optical sensors 148B-D are on one side of the source 144 and one optical sensor 148A is on the other side of the source 144. Each of the optical sensors 148A-D is operatively connected to the controller 112 to enable the optical sensors 148A-D to indicate to the controller whether an identifying feature is present in a segment of the face 212 at the edge in a manner as explained above with reference to reader 120. For example, in FIG. 1, light reflects from identifying feature surfaces 216A and 216B to optical sensors 148A and 148B, respectively, which generate an electronic signal corresponding to an amount of light received by the sensors.

In one embodiment, the optical sources 124 and 144 are 3 millimeter light-emitting diodes and the optical sensors 128A-D and 148A-D are 3 millimeter phototransistors, though any suitable size and type of light source and optical detector can be used in other embodiments. In some embodiments, the optical sources are operatively connected to the controller to enable the controller to selectively activate the optical sources in response to an ink stick being detected in the ink loader. In other embodiments, the optical sources could be activated as long as the printer is powered on. In the illustrated embodiment, the sensors 128A-D and 148A-D are positioned above the ink stick 200 in the loader to reduce the potential for contamination of the sensors 128A-D and 148A-D from foreign particles, although in other embodiments the optical sensors can be positioned in any suitable location in the ink loader. One example of an alternative optical sensing system uses multiple light emitters, for example, LEDs or LED laser elements, aimed at different feature locations. These light emitters are sequentially powered to enable reflected light to be directed toward a single optical detector. In this example, the stronger detector signal (s) indicate target features are present on the ink stick and the correlation of the emitter aimed at the feature position indicates which feature is present or not present from the intensity of the reflected light received by the detector.

Operation and control of the various subsystems, components and functions of the ink loader are performed with the aid of the controller 112. The controller 112 can be implemented with general or specialized programmable processors that execute programmed instructions. The instructions and data required to perform the programmed functions are stored in memory associated with the processors. The processors, their memories, and interface circuitry configure the controller 112 to perform the functions described above and the processes described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

In operation, a user places a solid ink stick 200 through the insertion port 104 and onto the ink stick support 108. The controller 112 is signaled to the presence of a solid ink stick 200 on the support by, for example, user input or another sensor (not shown) detecting the presence of the ink stick. Alternatively, one or both of the optical readers 120 and 140 can send a signal to the controller 112 indicating the presence of an ink stick 200 on the support 108.

In response, the controller 112 verifies activation of or activates optical source 124 for illumination of the face 204 with a beam of diffuse light 164. The portion 172 of the light that does not encounter an identifying feature is reflected away from the sensors 128A-D and the sensors 128A-D generate an electrical signal indicative of no identifying feature being detected. The other portion 168A of the light interacts with an identifying feature and is reflected from the surface 208A of an identifying feature toward optical sensor 128A. Optical sensor 128A receives the light 168A reflected from surface 208A and generates a signal in response that indicates the presence of the identifying feature on the ink stick 200. The remaining three sensors 128B-D do not receive an appreciable quantity of light, and therefore generate an electronic signal indicative of no identifying feature being present.

At substantially the same time as the first optical reader 120 is activated, the controller 112 verifies activation of or activates optical source 144 of the second optical reader 140 to direct a beam of diffuse light 184 at the face 212 of the ink stick 200. Timing of the operation of the second optical reader 140 is only significant for a rapid response, and any practical sequence or time delay can be used. A portion 192 of the light does not interact with an identifying feature and is not reflected into the sensor monitoring these areas of the face 212. Thus, sensors 148C-D generate electrical signals that indicate to the controller 112 that no identifying feature is present in the face 212 at the positions monitored by those sensors. The remaining portions of the light 188A and 188B reflect off surfaces 216A and 216B, respectively, toward optical sensors 148A and 148B. In response, each of the optical sensors 148A and 148B generates an electronic signal that indicates to the controller 112 that an identifying feature is present in the area of face 212 monitored by these sensors.

The controller 112 receives the electronic signals from sensors 128A, 148A, and 148B, which correspond to data identifying the ink stick 200. A memory of the controller 112 can be configured with data corresponding with the various permutations and combinations of binary values of the sensors for each reader and data stored in association with those permutations and combinations that enable the controller to determine one or more characteristics of the ink stick 200. Based on the information the controller 112 identifies about the ink stick 200, the controller 112 determines whether the ink stick is in an appropriate printer or whether the ink stick is in the correct feed channel of an appropriate printer. The controller is further configured to operate components of the printer to process the ink stick or perform exception processing for the inappropriate ink stick.

Figure 2:
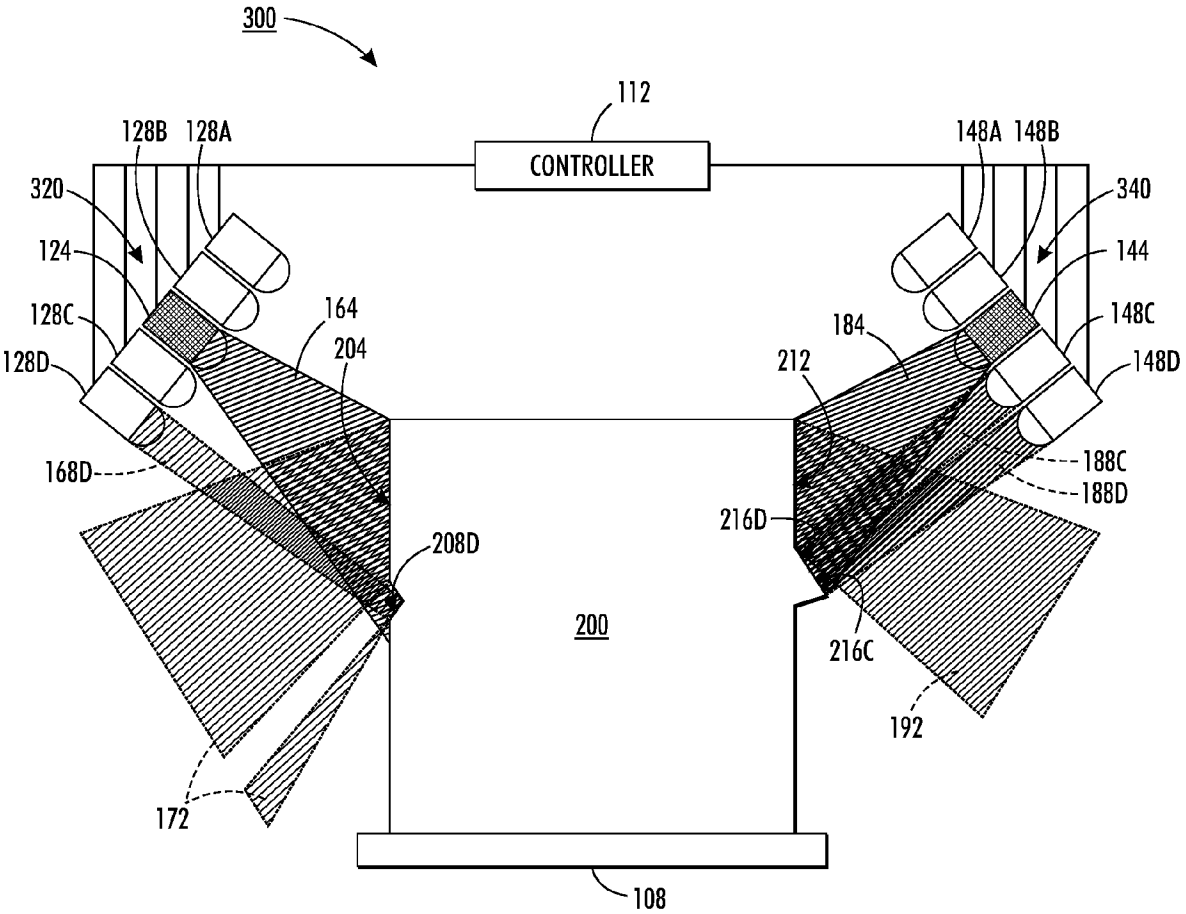
FIG. 2 is a side view of another ink loader having a different arrangement of multiple detectors and a single light emitter to enable detection of an identifying feature in a surface of an ink stick.

FIG. 2 depicts another ink loader 300, which includes an ink stick support 108, a controller 112, a first optical reader 320, and a second optical reader 340. The ink stick support 108 and controller 112 are configured substantially the same as described above with reference to FIG. 1. The ink stick support 108 enables a solid ink stick 200 to rest on the support 108 while the ink stick 200 is identified by the optical readers 320 and 340.

Optical reader 320 includes an optical source 124 and four optical sensors 128A-D, while optical reader 340 includes an optical source 144 and four optical sensors 148A-D. The optical sources 124 and 144 and optical sensors 128A-D and 148 A-D are substantially the same as the optical source and sensors described above with reference to FIG. 1. However, the optical sensors 128A-D are arranged in a line with two sensors 128A-B on one side of the optical source 124 and two sensors 128C-D on the other side of the optical source 124. Likewise, optical sensors 148A-D are arranged in a line with two sensors 148A-B on one side of optical source 144 and two sensors 148C-D on the other side of the optical source 144.

The embodiment of FIG. 2 operates in substantially the same manner as the embodiment of FIG. 1. Optical sources 124 and 144 emit a beam of diffuse light toward surfaces 204 and 212, respectively, of the solid ink stick. In the embodiment of FIG. 2, the majority of light beam 164 emitted by source 124 reflects off surface 204 away from the sensors (shown as reflected light 172), while a portion 168D of the light reflects off the feature surface 208D of the solid ink stick 200 toward optical sensor 128D. In response to receiving the reflected light, optical sensor 128D generates a signal that is delivered to the controller 112 indicating the presence of the feature on the ink stick 200. Optical source 144 emits a beam of light 184, of which a portion 192 reflects off surface 212, away from the sensors 148C-D, while the remaining portions 188C and 188D reflect off feature surfaces 216C and 216D, respectively. The portions 188C and 188D reflecting off surfaces 216C and 216D are directed at optical sensors 148C and 148D, respectively, which generate electronic signals indicating the presence of the identifying features. Sensors 148C and 148D, however, generate electrical signals that indicate the identifying features are not present in the areas of the ink stick monitored by those sensors. The controller 112 receives the electronic signals from all of the sensors in the readers 320 and 340. The controller identifies the ink stick 200 in the loader 300 by correlating the electronic signals received from the sensors with data stored in the memory of the controller 112.

Figure 3:
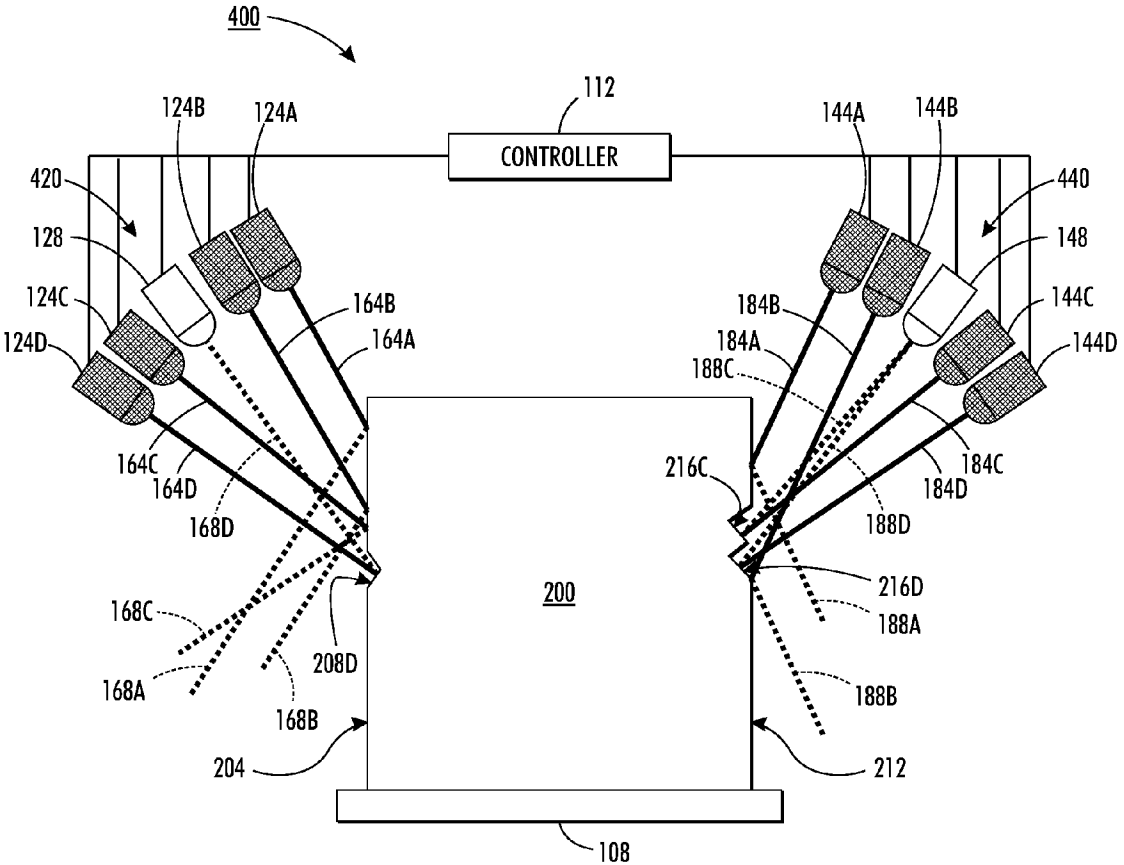
FIG. 3 is a side view of yet another ink loader having multiple light emitters and a single light detector to enable detection of an identifying feature in a surface of an ink stick.

FIG. 3 depicts another ink loader 400, which includes an ink stick support 108, a controller 112, a first optical reader 420, and a second optical reader 440. The ink stick support 108 and controller 112 are configured substantially the same as described above with reference to FIG. 1. The ink stick support 108 enables a solid ink stick 200 to rest on the support 108 while the ink stick 200 is identified by the optical readers 420 and 440.

Optical reader 420 includes four optical sources 128A-D and one optical sensor 128, while optical reader 440 includes four optical sources 144A-D and one optical sensor 148. The optical sources 124A-D and 144A-D and optical sensors 128 and 148 are substantially the same as the optical source and sensors described above with reference to FIG. 1. However, the emitters of the embodiment of FIG. 3 are shown as lasers, for example LED lasers, emitting focused light. In other embodiments, optical readers having multiple optical sources can emit diffuse light similar to the embodiments of FIGS. 1 and 2. The optical sources 124A-D are arranged at a slight angle to one another, with two sources 124A-B on one side of the optical sensor 128 and two sources 124C-D on the other side of the optical sensor 128. Likewise, optical sources 144A-D are arranged at a slight angle to one another with two sources 144A-B on one side of optical sensor 148 and two sources 144C-D on the other side of the optical sensor 148.

In operation, the controller 112 generates signals to activate the optical sources 124A-D and 144A-D in sequence to emit a beam of diffuse light toward surfaces 204 and 212, respectively, of the solid ink stick. For example, the controller 112 can be configured to activate optical sources 124A and 144A, followed by 124B and 144B, then 124C and 144C, and finally 124D and 144D. The sources can be activated in any sequence in other embodiments, as long as only one source on each side is active at any time. The optical sensors 128 and 148 generate a signal corresponding to the amount of reflected each time one of the corresponding sources 124A-D and 144A-D are activated. In the embodiment of FIG. 3, light beams 164A-C and 184A-B emitted by sources 124A-C and 144A-B, respectively, reflect off surface 204 away from the sensors (shown as reflected light 168A-C and 188 A-B, respectively), which generate signals corresponding to a low amount of detected light. Light beams 164D and 184C-D reflect off the feature surface 208D and 216C-D, respectively, (shown as reflected light 164D and 184C-D) of the solid ink stick 200 toward optical sensors 124 and 144, as the optical sources are activated, and the optical sensors 124 and 144 deliver a signal to the controller 112 indicative of a high amount of detected light. The controller 112 receives all the electronic signals from the sensors 124 and 144. Based on the strength of the light detected by the sensors 124 and 144, the controller determines the features present on the ink stick and identifies the ink stick 200 in the loader 400 by correlating these electronic signals with data stored in the memory of the controller 112.

It will be appreciated that variations of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An ink loader for a solid ink imaging device comprising:

an insertion port having a support, the insertion port being configured to receive a solid ink stick and enable the solid ink stick to rest on the support;

a first optical source in the insertion port, the first optical source being oriented to emit diffuse light toward a first face of the solid ink stick resting on the support;

at least two optical sensors in the insertion port that are oriented to receive light reflected from the first face of the solid ink stick, the at least two optical sensors being oriented for different angles of reflection with respect to the first face of the solid ink stick to enable each optical sensor in the at least two optical sensors to receive reflected light from different portions of the first face of the solid ink stick and generate a signal corresponding to an amount of received reflected light;

a second optical source in the insertion port, the second optical source being oriented to emit diffuse light toward a second face of the solid ink stick resting on the support, the second face being different than the first face of the solid ink stick;

at least two more optical sensors in the insertion port that are oriented to receive light reflected from the second face of the solid ink stick, the at least two more optical sensors being oriented for different angles of reflection with respect to the second face of the solid ink stick to enable each optical sensor in the at least two more optical sensors to receive reflected light from different portions of the second face of the solid ink stick and generate a signal corresponding to an amount of received reflected light; and a controller operatively connected the first optical source, the second optical source, to the at least two optical sensors and the at least two more optical sensors, the controller being configured activate the first optical source and the second optical source in a predetermined sequence, and to identify a first feature of the solid ink stick from the signals generated by the at least two optical sensors and to identify a second feature of the solid ink stick from the signals generated by the at least two more optical sensors.

2. The ink loader of claim 1, the at least two optical sensors further comprising:

four optical sensors, each of the four optical sensors being oriented with respect to the first face of the solid ink stick to receive reflected light from a different portion of the first face of the solid ink stick than the other three optical sensors in the four optical sensors.

3. The ink loader of claim 2 wherein at least one optical sensor is positioned on a side of the first optical source that is opposite a side of the first optical sensor on which another optical sensor is positioned.

4. The ink loader of claim 2, the at least two more optical sensors further comprising:

four optical sensors, each of the four optical sensors being oriented with respect to the second face of the solid ink stick to receive reflected light from a different portion of the second face of the solid ink stick than the other three optical sensors in the four optical sensors.

5. The ink loader of claim 4 wherein two optical sensors of the at least two more optical sensors are positioned on either side of the second optical source.

6. The ink loader of claim 2 wherein three optical sensors of the four optical sensors are positioned on one side of the first optical source and the other of the four optical sensors is positioned on another side of the first optical source.

7. The ink loader of claim 1, the at least two more optical sensors further comprising:

four optical sensors, each of the four optical sensors being oriented with respect to the second face of the solid ink stick to receive reflected light from a different portion of the second face of the solid ink stick than the other three optical sensors in the four optical sensors.

8. The ink loader of claim 7 wherein at least one optical sensor is positioned on a side of the first optical source that is opposite a side of the first optical sensor on which another optical sensor is positioned.

9. The ink loader of claim 7 wherein three optical sensors of the four optical sensors are positioned on one side of the second optical source and the other of the four optical sensors is positioned on another side of the second optical source.

10. The ink loader of claim 1, the controller being further configured to identify a color of the solid ink stick with reference to the signals generated by the at least two optical sensors.

11. The ink loader of claim 1, the controller being further configured to identify a configuration of the solid ink stick with reference to the signals generated by the at least two more optical sensors.

12. The ink loader of claim 1 wherein the first and the second optical sources are light-emitting diodes.

13. The ink loader of claim 1, the first optical source and the second optical source being positioned in the port to illuminate opposite faces of the solid ink stick in the port.

14. The ink loader of claim 1, the first optical source and the at least two optical sensors being positioned on a side of the ink stick in the port that is opposite the second optical source and the at least two more optical sensors.

15. An ink loader for a solid ink imaging device comprising:

an insertion port having a support, the insertion port being configured to receive a solid ink stick and enable the solid ink stick to rest on the support;

at least two optical sources in the insertion port, the at least two optical sources being oriented to emit light toward a first face of the solid ink stick resting on the support, each of the at least two optical sources being oriented for different angles of reflection with respect to the first face of the solid ink stick;

a first optical sensor in the insertion port, the first optical sensor being oriented to receive light emitted by the at least two optical sources that is reflected from the first face of the solid ink stick, the first optical sensor being configured to generate a signal corresponding to an amount of reflected light received from the first face of the solid ink stick from each of the at least two optical sources;

at least two more optical sources in the insertion port, the at least two more optical sources being oriented to emit light toward a second face of the solid ink stick resting on the support, each of the at least two more optical sources being oriented for different angles of reflection with respect to the second face of the solid ink stick;

a second optical sensor in the insertion port, the second optical sensor being oriented to receive light emitted by the at least two more optical sources reflected from the second face of the solid ink stick, the second optical sensor being configured to generate signals corresponding to an amount of reflected light received from the second face of the solid ink stick from each of the at least two more optical sources; and a controller operatively connected to the first optical sensor, the second optical sensor, the at least two optical sources, and the at least two more optical sources, the controller being configured to activate each of the at least two optical sources and each of the at least two more optical sources in a predetermined sequence, and identify a first feature of the solid ink stick from the signals generated by the first optical sensor and to identify a second feature of the solid ink stick from the signals generated by the second optical sensor.

16. The ink loader of claim 15, the at least two optical sources further comprising:

four optical sources, each of the four optical sources being oriented with respect to the first face of the solid ink stick to reflect light from a different portion of the first face of the solid ink stick than the other three optical sources in the four optical sources.

17. The ink loader of claim 15, the at least two more optical sources further comprising:

four optical sources, each of the four optical sources being oriented with respect to the second face of the solid ink stick to reflect light from a different portion of the second face of the solid ink stick than the other three optical sources in the four optical sources.

18. The ink loader of claim 15 wherein at least one optical source is positioned on a side of the first optical sensor that is opposite a side of the first optical sensor on which another optical sensor is positioned.

19. The ink loader of claim 15 wherein at least one optical source is positioned on a side of the second optical sensor that is opposite a side of the second optical sensor on which another optical sensor is positioned.

20. The ink loader of claim 15, the at least two optical sources and the first optical sensor being positioned on a side of the ink stick in the port that is opposite the at least two more optical sources and the second optical sensor.

* * * * *